US009007268B2

(12) United States Patent
Focke et al.

(10) Patent No.: US 9,007,268 B2
(45) Date of Patent: Apr. 14, 2015

(54) ANTENNA

(75) Inventors: Thomas Focke, Ahrbergen (DE); Joerg Hilsebecher, Hildesheim (DE); Oliver Lange, Hannover (DE); Reinhard Meschenmoser, Hannover (DE); Arne Zender, Bad Salzdetfurth (DE); Thomas Schoeberl, Hildesheim (DE); Thomas Hansen, Hildesheim (DE); Joachim Selinger, Stuttgart (DE); Karl Schneider, Burgstetten (DE)

(73) Assignee: Robert Bosch GmbH, Stuttgart (DE)

( * ) Notice: Subject to any disclaimer, the term of this patent is extended or adjusted under 35 U.S.C. 154(b) by 1060 days.

(21) Appl. No.: 12/979,691

(22) Filed: Dec. 28, 2010

(65) Prior Publication Data

US 2012/0026053 A1 Feb. 2, 2012

(30) Foreign Application Priority Data

Dec. 29, 2009 (DE) ..... 10 2009 055 344

(51) Int. Cl.

| | |
|---|---|
| ***H01Q 13/10*** | (2006.01) |
| ***H01Q 21/00*** | (2006.01) |
| ***H01Q 1/00*** | (2006.01) |
| ***H01Q 19/06*** | (2006.01) |
| ***H01Q 21/06*** | (2006.01) |

(52) U.S. Cl.

CPC ..... *H01Q 21/0087* (2013.01); *H01Q 19/06* (2013.01); *H01Q 21/005* (2013.01); *H01Q 21/0068* (2013.01); *H01Q 21/061* (2013.01); *H01Q 21/065* (2013.01)

(58) Field of Classification Search

CPC ..... H01Q 21/005; H01Q 21/065

See application file for complete search history.

(56) References Cited

U.S. PATENT DOCUMENTS

| | | | | |
|---|---|---|---|---|
| 3,197,774 | A | 7/1965 | Goldbohm | |
| 3,795,915 | A | 3/1974 | Yoshida | |
| 4,742,355 | A | 5/1988 | Wolfson et al. | |
| 4,912,474 | A | 3/1990 | Paturel et al. | |
| 5,661,493 | A * | 8/1997 | Uher et al. | 343/700 MS |
| 6,452,550 | B1 | 9/2002 | Channabasappa et al. | |
| 2004/0080463 | A1 | 4/2004 | Jeong | |
| 2004/0174315 | A1 | 9/2004 | Miyata | |

FOREIGN PATENT DOCUMENTS

| | | |
|---|---|---|
| DE | 102004053419 | 5/2006 |
| DE | 10 2007 056 910 | 5/2009 |

(Continued)

OTHER PUBLICATIONS

Coetzee et al. ("A meandering waveguide planar slot array" 1999 Asia Pacific Microwave Conference; vol. 3, p. 917-919 Nov. 30, 1999).*

*Primary Examiner* — Dameon E Levi
*Assistant Examiner* — Ricardo Magallanes
(74) *Attorney, Agent, or Firm* — Kenyon & Kenyon LLP

(57) ABSTRACT

An antenna has an antenna body having a plurality of first antenna elements, which are disposed along a first straight line. A hollow conductor, which extends between the first antenna elements, is disposed in the antenna body. The first antenna elements are developed as openings running between the hollow conductor and a surface of the antenna body. The antenna is designed to radiate a signal in a spatial direction that is a function of a frequency of the signal. The antenna body has an electrically insulating material that is coated with a conductive material.

19 Claims, 9 Drawing Sheets

(56) References Cited

FOREIGN PATENT DOCUMENTS

| | | | | | |
|---|---|---|---|---|---|
| EP | 0 825 671 | 2/1998 | | | |
| EP | 1 199 772 | 4/2002 | | | |
| EP | 2 211 420 | 7/2010 | | | |
| GB | 2463711 | * | 3/2010 | ..... | 343/770 |
| WO | 95/20169 | 7/1995 | | | |

* cited by examiner

ANTENNA

RELATED APPLICATION INFORMATION

The present application claims priority to and the benefit of German patent application no. 10 2009 055 344.4, which was filed in Germany on Dec. 29, 2009, the disclosure of which is incorporated herein by reference.

FIELD OF THE INVENTION

The present invention relates to an antenna.

BACKGROUND INFORMATION

Radar systems use antennas to radiate radar beams. Radar systems are known which scan a visual range using a bundled radar beam. This requires an antenna that radiates in only one narrowly defined spatial direction. In addition, this spatial direction of the radiation must be modifiable so that the visual range can be scanned sequentially. Antennas which are suitable for such a task are also referred to as scanners.

Furthermore, antennas are known for which the radiation direction is a function of the frequency of the radiated radar beam. Such antennas are referred to as frequency scanners and are discussed in WO 95/20169 and DE 10 2007 056 910.8, for example. However, currently known frequency-scanning antennas are complex and expensive in the production and offer only a suboptimal directional characteristic or beam bundling.

SUMMARY OF THE INVENTION

Therefore, it is an object of the exemplary embodiments and/or exemplary methods of the present invention to provide an improved antenna. According to the exemplary embodiments and/or exemplary methods of the present invention, this objective is achieved by an antenna having the features described herein. Refinements are also described and specified herein.

An antenna according to the present invention has an antenna body equipped with a plurality of first antenna elements, which are disposed along a first straight line. A hollow conductor, which runs between the first antenna elements, is disposed inside the antenna body, the first antenna elements being implemented as openings that run between the hollow conductor and a surface of the antenna body. Furthermore, the antenna is designed to radiate a signal in a spatial direction that is a function of a frequency of the signal. The antenna body has an electrically insulating material which is coated with a conductive material. The antenna body is advantageously able to be produced from an electrically insulating material in a more cost-effective manner than an antenna body made of metal.

The insulating material may be polyetherimide or polybutylene terepthalate. These plastic materials have the advantage of being cost-effective, easy to process, and mechanically robust.

The antenna body may be produced by an injection molding process. A production using an injection molding process is advantageously easier and more cost-effective than milling the antenna body from a block of material.

According to one alternative embodiment, the insulating material is glass. Glass, too, advantageously constitutes a cost-effective and easily processable material that has suitable mechanical properties.

The antenna body is then expediently produced by an embossing method. Embossing methods likewise offer the advantage of allowing a cost-effective and simple production.

The electrically conductive material may be applied by a physical vapor-phase deposition, or with the aid of a galvanic coating method. These coating methods advantageously allow the deposition of a very thin conductive material layer.

A medium that is transparent to radar radiation may be provided inside the hollow conductor. This has the advantage that the conductive material is able to be protected from corrosion.

The hollow conductor may have at least one compensation structure, which is designed to compensate for any interference at the hollow conductor as a result of reflections at the first antenna elements. This advantageously makes it possible to improve the radiation characteristic of the antenna.

At least two of the first antenna elements expediently differ from each other such that they differ in the amount of their radiation output. This advantageously makes it possible to optimize the antenna configuration, which allows an especially advantageous radiation characteristic to be obtained.

In an especially particular manner, the output radiated by the first antenna elements interferes in such a manner that a side lobe attenuation of the radiated output amounts to more than 25 dB in the distant field.

The first antenna elements expediently include an outer antenna element and a central antenna element, the opening forming the outer antenna element having a first diameter, and the opening forming the second antenna element having a second diameter. The first and the second diameters are of different size. The antenna configurations may then advantageously be adjusted via the size of the holes.

In an especially advantageous manner, the first antenna elements include a center first antenna element; the output radiated by a first antenna element is approximately proportional to the square of the cosine of the distance, scaled to $\pi/2$, of this first antenna element from the center first antenna element. Tests and calculations advantageously have shown that the use of such antenna configurations makes it possible to achieve an especially advantageous radiation characteristic of the antenna.

In one further development, the antenna has a lens in the form of a cylinder segment. A longitudinal axis of the lens is oriented in parallel with the first straight line. In addition, the lens has a dielectric material. This advantageously makes it possible to focus the beam radiated by the antenna in a direction that runs perpendicular to the swiveling direction of the antenna. This increases the antenna gain.

The lens expediently includes polyetherimide. This material has advantageously been shown to be especially suitable.

In one further development, the antenna has a plurality of second antenna elements, which are disposed outside of the first straight line. The second antenna elements are implemented as patch elements, and at least two of the second antenna elements are connected to each other by a microstrip. The second antenna elements are then advantageously able to be used for detecting a reflected radar signal and thereby improve the resolution of the antenna in a direction that runs perpendicular to the swiveling direction of the antenna. The second antenna elements may also be used for emitting a radar signal.

The second antenna elements may be disposed in one row, which is oriented parallel to the first straight line. The second antenna elements in the row are connected to each other via a microstrip. In an advantageous manner, this system is particularly suitable for detecting the reflected signal, but it may also be used for emitting a radar signal.

In an additional further development, the antenna includes a second antenna body, which has a plurality of third antenna elements, which are disposed along a second straight line. The second straight line is oriented parallel to the first straight line. Furthermore, a second hollow conductor is disposed in the second antenna body, which runs between the third antenna elements. In addition, the third antenna elements are formed as openings running between the second hollow conductor and a surface of the second antenna body. In an advantageous manner, the second antenna body may then be used either for detecting a reflected radar signal, which improves the resolution of the antenna in a direction perpendicular to the swiveling direction of the antenna, or the signals radiated by the first and second antenna bodies may interfere in such a way that improved focusing results perpendicular to the swiveling direction of the antenna.

In one still further development of the antenna, at least one antenna column is provided with a plurality of fifth antenna elements, the antenna column being oriented perpendicular to the first straight line, and the antenna column being coupled to a first antenna element via a coupling structure. In an advantageous manner, the antenna column then brings about focusing of the signals emitted by the antenna, in a direction that is perpendicular to the swiveling direction of the antenna. This improves the radiation characteristic of the antenna.

According to one specific embodiment, the antenna column is implemented as microstrip antenna, the fifth antenna elements being developed as patch elements. The antenna column is then advantageously able to be produced in a simple and cost-effective manner.

A substrate is expediently provided between the antenna body and the antenna column. The substrate advantageously provides an electrical insulation of the antenna column from the antenna body.

According to one alternative specific embodiment, the antenna column is designed as hollow conductor, the fifth antenna elements being implemented as openings in this hollow conductor. In an advantageous manner, such an antenna column designed as hollow conductor likewise brings about focusing of the signal radiated by the antenna, in a direction perpendicular to the swiveling direction of the antenna.

In the following, the exemplary embodiments and/or exemplary methods of the present invention are explained in greater detail with reference to the attached drawing. Matching reference numerals have been used for elements that are the same or act the same.

DETAILED DESCRIPTION

Figure 1:
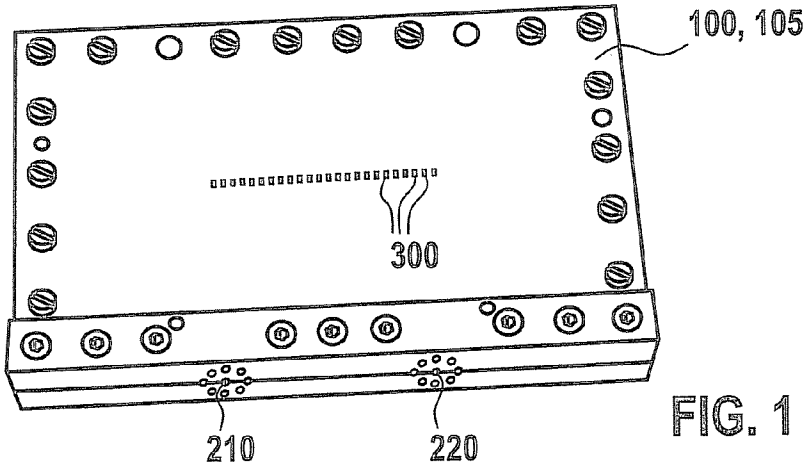
FIG. 1 shows a perspective view of an antenna body of an antenna.
Figure 2:
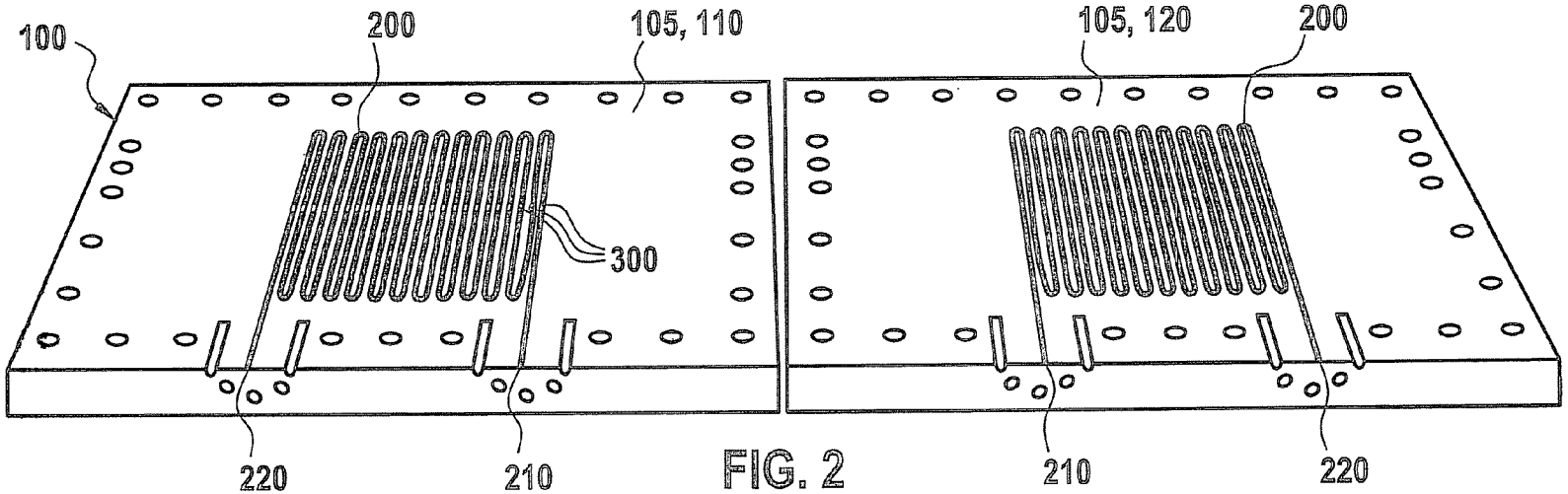
FIG. 2 shows a perspective view of the open antenna body, including a hollow conductor disposed therein.

FIGS. 1 and 2 show a perspective view of an antenna body 105 of an antenna 100. Antenna body 105 has an upper part 110 and a lower part 120. In the illustration of FIG. 1, upper part 110 and lower part 120 of antenna body 105 are connected to each other by screws. FIG. 2 shows upper part 110 and lower part 120 of antenna body 105 in the unconnected state. Upper part 110 and lower part 120 are developed as essentially flat cubes. Upper part 110 and lower part 120 of the antenna body may be joined in such a way that a surface of upper part 110 is brought into contact with a surface of lower part 120.

The joinable surfaces of upper part 110 and lower part 120 each have a meander-type, groove-shaped depression. If upper part 110 and lower part 120 are joined, then the groove-type depressions supplement each other and form a hollow conductor 200 running in the interior of antenna body 105. Hollow conductor 200 extends between an input 210 disposed at an edge of antenna body 105, and an output 220 disposed on the same edge of antenna body 105. Via input 210 and output 220, a high-frequency electromagnetic signal is able to be coupled into and out of hollow conductor 200. The signal may have a frequency of 77 GHz, for example. To swivel the radar beam emitted by antenna 100, the frequency may be varied by an amount of 2 GHz, for instance.

Upper part 110 of antenna body 105 has a plurality of first antenna elements 300, which are situated along a straight line. First antenna elements 300 are developed as openings that run between an outer surface of antenna body 105 and hollow conductor 200 in the interior of antenna body 105. The straight line, along which first antenna elements 300 are disposed, extends parallel to the extension direction of meander-type hollow conductor 200. Each turn of meander-type hollow conductor 200 has an opening forming an antenna element 300. Each antenna element 300 is disposed in the center between two successive turns of hollow conductor 200. However, it is also possible to place antenna elements 300 at other positions of hollow conductor 200, such as in the proximity of, or directly at, the turns of the meander-type extension of hollow conductor 200. For example, 24 or 48 or a different number of antenna elements 300 may be provided. The direct distance between two adjacent antenna elements 300 is selected as a function of the frequency of the signal to be radiated into hollow conductor 200 and may correspond to one half of the wavelength of the signal, for instance. Because of the meander form of hollow conductor 200, the length of hollow conductor 200 between two adjacent antenna elements 300 is greater and, for example, may correspond to approximately 5.5 times the wavelength of the signal.

Antenna body 105 is made from an electrically insulating material, which is coated with a conductive material. The electrically insulating material may be a plastic material, for example, which may be polyetherimide or polybutylene terephthalate. In this case, antenna body 105 may be produced by an injection molding process, for example. As an alternative, antenna body 105 may also be made from glass. In this case, antenna body 105 may be produced by an embossing method, for example. Antenna body 105 may also be made of some other insulating material. A coating of a conductive material is applied on top of the insulating material of antenna body 105. This is necessary so that hollow conductor 200 is suitable for transmitting an electromagnetic wave. The conductive coating may consist of different layer combinations and materials. A coating with gold or aluminum at a thickness of only a few micrometers has shown to be especially suitable. The coating may be applied with the aid of a physical vapor phase deposition, for instance, or with the aid of a galvanic coating method.

In addition, in order to protect the conductive coating from corrosion, hollow conductor 200 may be filled with a medium that is transparent to radar radiation. Suitable for this purpose are low-reaction gases, Teflon, various foams or also a vacuum, for instance. Either only hollow conductor 200 is filled with the medium, for which purpose antenna elements 300, input 210, and output 220 must be sealed by a medium that is transparent to radar radiation or, as an alternative, also entire antenna body 105 may be situated in the desired medium.

Figure 3:
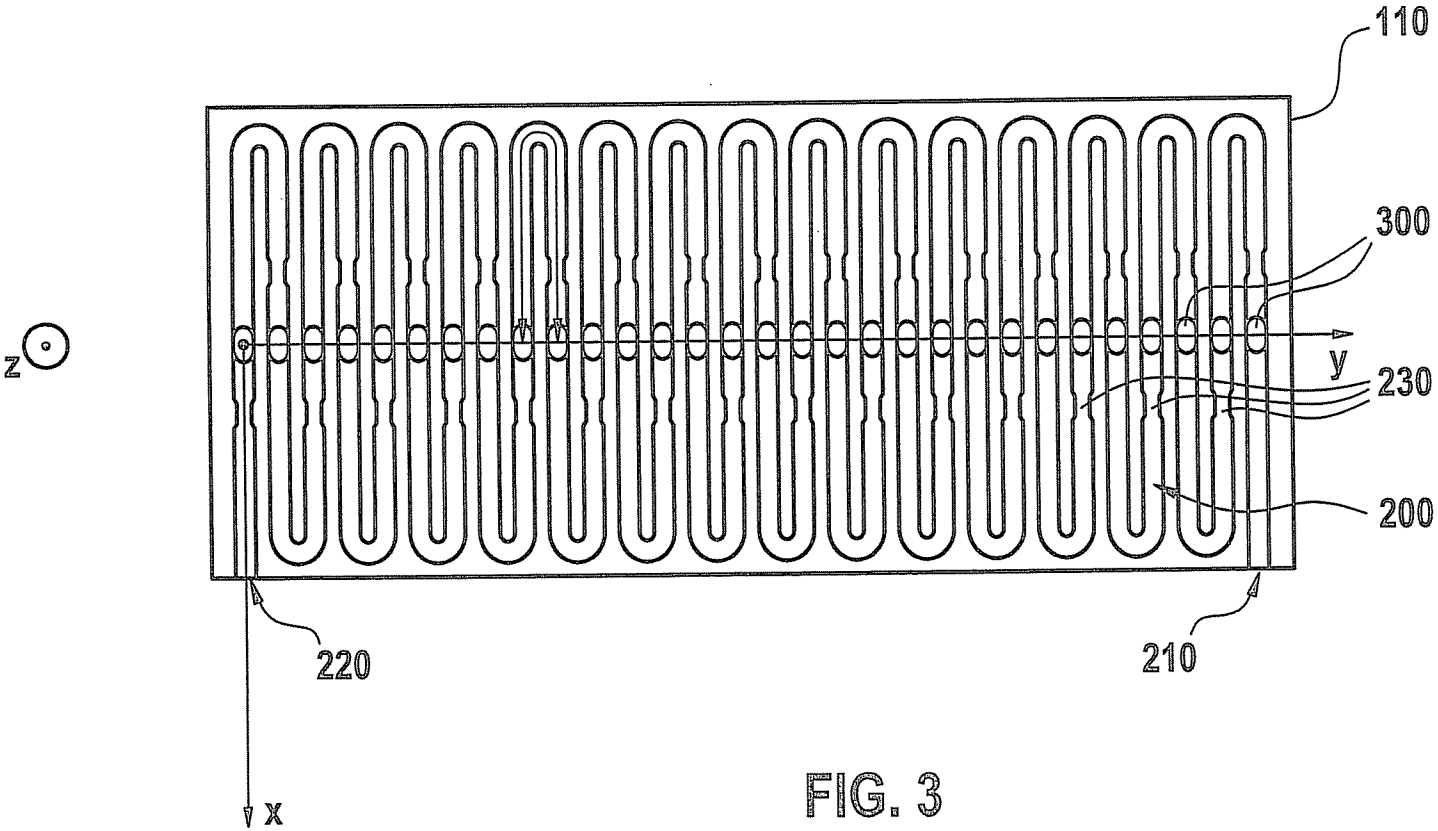
FIG. 3 shows a schematized illustration of the hollow conductor.

FIG. 3 shows another schematized illustration of hollow conductor 200 in the interior of antenna body 105 of antenna 100. Hollow conductor 200 is made up of a plurality of segments that are oriented parallel to the x-axis and are interconnected in meander-form by turns such that hollow conductor 200 extends in the y-direction overall. First antenna elements 300 are disposed along the first straight line, which is oriented parallel to the y-axis. First antenna elements 300 developed as openings to hollow conductor 200 constitute interference of hollow conductor 200 and have an adverse effect on its waveguide characteristics. To compensate for the interference of hollow conductor 200 caused by first antenna elements 300, hollow conductor 200 has a plurality of compensation structures 230. Compensation structures 230 are developed as tapered regions of hollow conductor 200 in the vicinity of the openings forming first antenna elements 300. Compensation structures 230 are dimensioned such that they compensate for the effect of first antenna elements 300 on hollow conductor 200. It is also possible to place compensation structures 230 in other locations, for example at a greater distance from the first antenna elements. It has shown to be especially advantageous, however, if compensation structures 230 are provided as closely as possible to first antenna elements 300. Compensation structures 230 improve the radiation characteristics of antenna 100.

Figure 4:
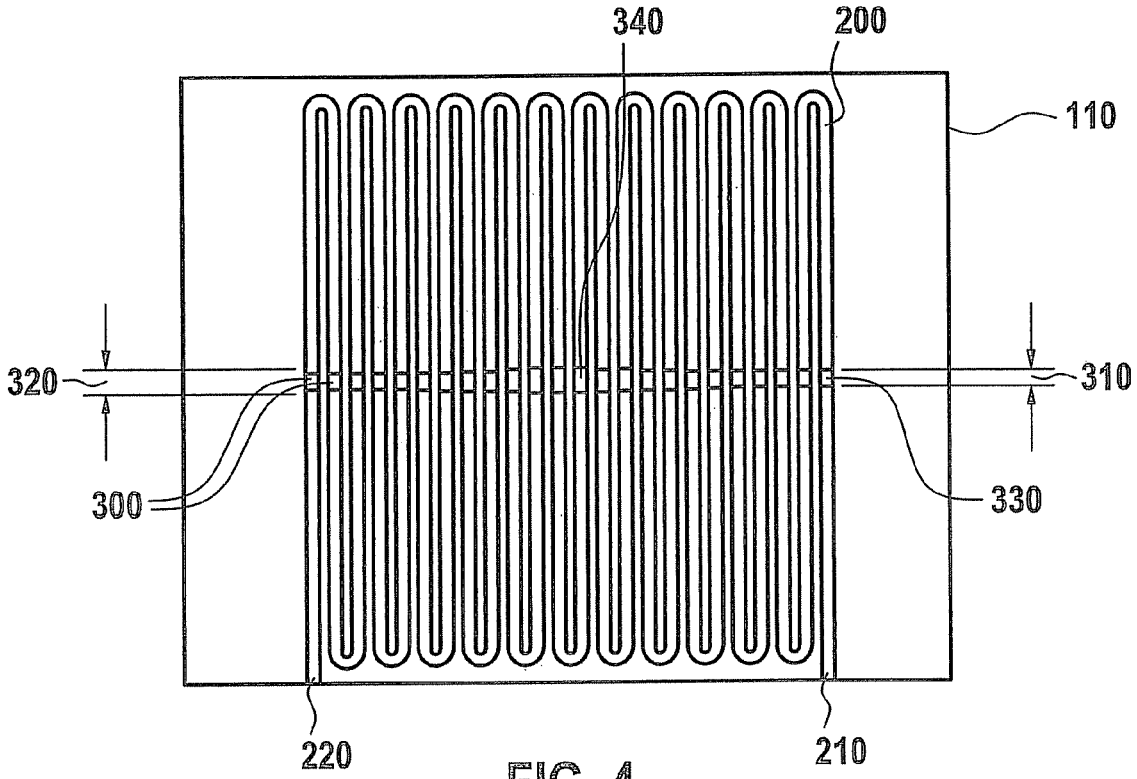
FIG. 4 shows a further illustration of the hollow conductor together with antenna elements.

FIG. 4 shows another view of upper part 110 of antenna body 105 and hollow conductor 200 disposed therein. FIG. 4 illustrates that the openings forming first antenna elements 300 have different diameters. The openings need not necessarily have a circular design, but may also have some other form such as a rectangular form. In this context the term diameter denotes the size of the opening, regardless of the precise shape of the opening. An outer antenna element 330 lying nearest to input 210 of hollow conductor 200 has a first diameter 310. A central antenna element 340 lying in the center of hollow conductor 200 has a second diameter 320. Second diameter 320 is larger than first diameter 310. First antenna elements 300 disposed between central antenna element 340 and outer antenna element 330 have diameters that are between first diameter 310 and second diameter 320. The diameter of first antenna elements 300 increases toward the center of hollow conductor 200. This applies analogously to first antenna elements 300 lying between output 220 of hollow conductor 200 and the center of hollow conductor 200.

The size of the holes forming first antenna elements 300 specifies the output radiated by first antenna elements 300. The distribution of the outputs radiated by the different first antenna elements 300 is referred to as antenna configuration. The development of the antenna configuration has a decisive influence on the directional characteristic of antenna 100. Given a constant configuration, when all first antenna elements 300 radiate approximately the same output, a directional characteristic results that has only a slight side lobe attenuation. An improved antenna configuration, however, makes it possible to improve the side lobe attenuation as well. The directional characteristic of antenna 100 in the distant field results from a Fourier transformation of the antenna configuration. Based on the desired distant field of antenna 100, a suitable antenna configuration is thus able to be calculated. An antenna configuration in which the radiated output of each first antenna element 300 is approximately proportional to the square of the cosine of the distance, scaled to $\Pi/2$, of the particular first antenna element 300 to central antenna element 340 has shown to be especially advantageous. The scaled distance of outer antenna element 330 from central antenna element 340 corresponds to a value of $\pi/2$. The output radiated by outer antenna element 330 is proportional to the square of the cosine of $\pi/2$, that is to say, equal to zero. Correspondingly, antenna elements 300 disposed between outer antenna element 330 and central antenna element 340 have a scaled distance from central antenna element 340 that is smaller than $\pi/2$. Outermost antenna elements 330, which radiate an output of zero, may of course also be omitted. However, other antenna configurations are possible as well. Overall, a side lobe attenuation of the radiated output of more than 25 dB is achievable in the distant field of antenna 100.

The exact diameters of the openings forming first antenna elements 300 result from the desired antenna configuration and a correction, which takes into account that the high-frequency electromagnetic signal is transmitted to hollow conductor 200 on one side through input 210. As a consequence, antenna elements 300 more remote from input 210 must have a larger diameter than antenna elements 300 situated in close proximity to input 210.

Figure 5:
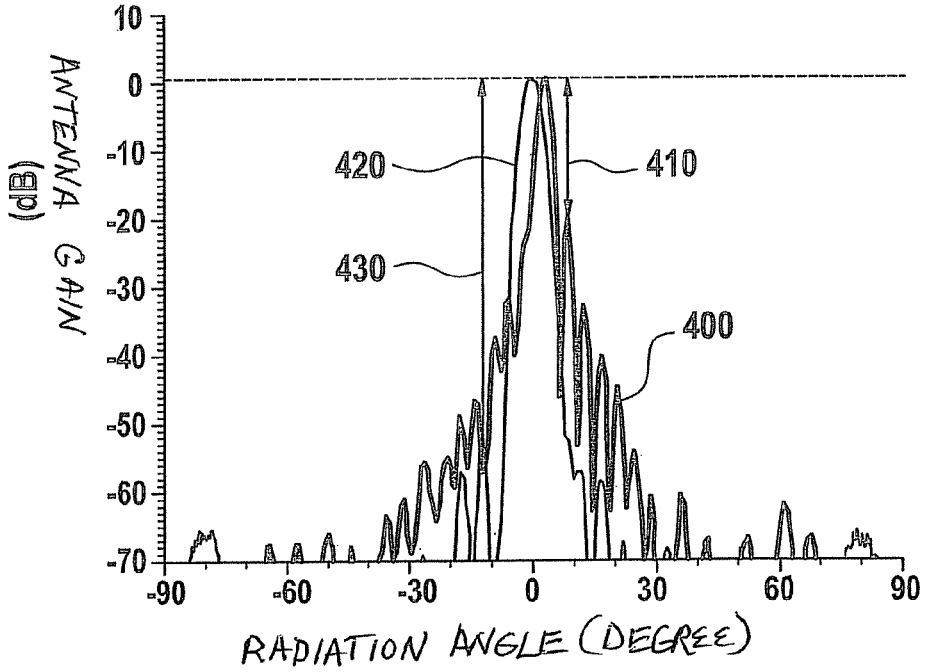
FIG. 5 shows a graphic illustration of the radiation characteristic of the antenna.

As explained, the side lobe attenuation of the signal radiated by the antenna is thus able to be optimized by a suitable antenna configuration of first antenna elements 300. FIG. 5, using a schematized illustration, shows a comparison of the directional characteristics of an antenna 100 including the described compensation structures 230 and an optimized antenna configuration of first antenna elements 300, in comparison with the directional characteristic of an antenna without the described optimizations. The antenna's angle of radiation is plotted on the horizontal axis, and a scaled antenna gain is plotted on the vertical axis. First directional characteristic 400 of the non-optimized antenna has a first side lobe attenuation 410. A second directional characteristic 420 of optimized antenna 100 has a second side lobe attenuation 430. It can be gathered that second side lobe attenuation 430 of optimized antenna 100 is better than first side lobe attenuation 410 of the non-optimized antenna.

Figure 6:
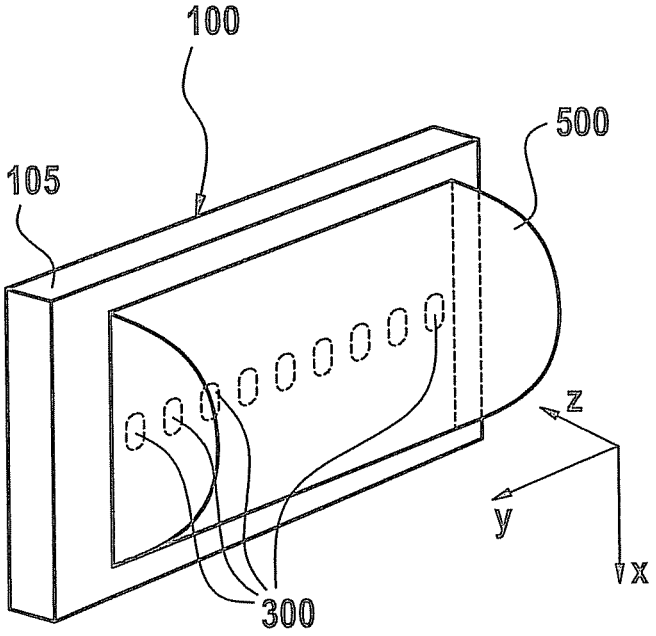
FIG. 6 shows a perspective view of the antenna having a cylindrical lens.

FIG. 6 shows another perspective view of antenna 100 having antenna body 105. First antenna elements 300 of antenna 100 are disposed along the first straight line, which is oriented parallel to the y-axis. By varying the frequency of the high-frequency signal coupled into hollow conductor 200, the angle of radiation of antenna 100 changes in the y-z plane.

However, antenna 100 radiates in a broad angular range in the x-direction. Therefore, a lens 500 is disposed in front of antenna body 105 in FIG. 6. Lens 500 is in the form of a cylinder segment, whose longitudinal axis is oriented parallel to the y-axis. Lens 500 focuses the beam radiated via antenna 100 in the x-direction and thereby increases the gain of antenna 100. In the y-direction, the signal radiated by antenna 100 is not modified by lens 500. Lens 500 may be made from different materials. Experience has shown that polyetherimide is especially suitable. Lens 500 is able to increase the antenna gain of antenna 100 by up to 7 dB.

Figure 7:
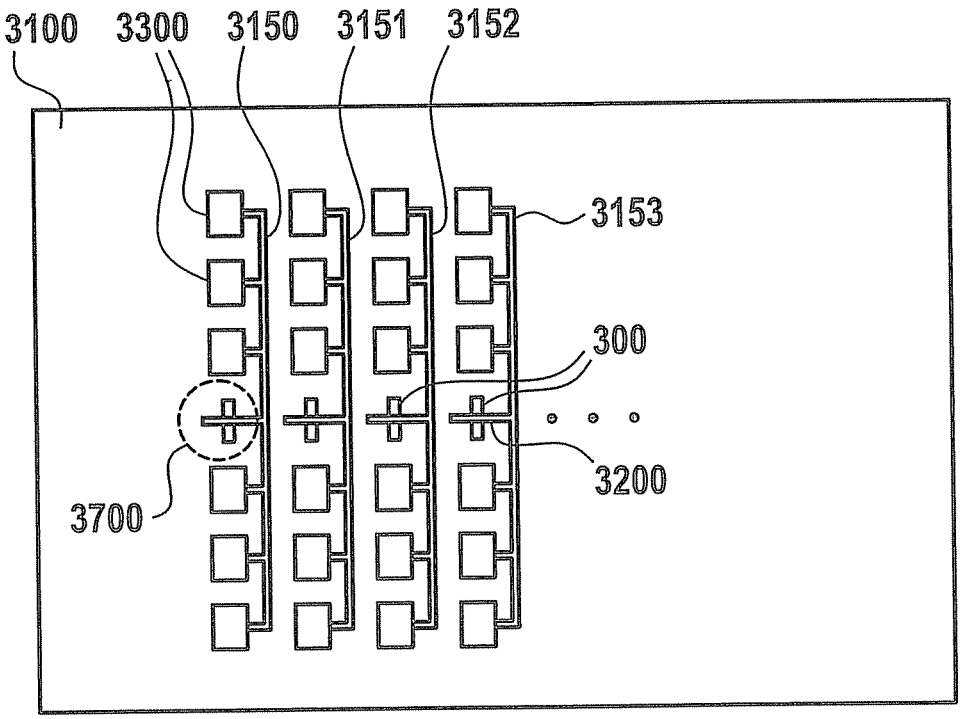
FIG. 7 shows an illustration of the antenna having additional antenna columns according to a first specific development.

FIG. 7 shows a plan view of an antenna 3100 according to another specific embodiment. Antenna 3100 once again has first antenna elements 300, which are disposed along the first straight line. In addition, antenna 3100 has additional antenna columns, which are oriented perpendicular to the first straight line. In FIG. 7, a first antenna column 3150, a second antenna column 3151, a third antenna column 3152, and a fourth antenna column 3153 are shown. Antenna 3100 may have as many antenna columns 3150, 3151, 3152, 3153 as there are first antenna elements 300. Each antenna column 3150, 3151, 3152, 3153 has a plurality of fifth antenna elements 3300, which are developed as patch elements. In the example of FIG. 7, each antenna column 3150, 3151, 3152, 3153 has six fifth antenna elements 3300. Fifth antenna elements 3300 of an antenna column 3150, 3151, 3152, 3153 are interconnected via a separate microstrip in each case. The microstrip and fifth antenna elements 3300 are made from an electrically conductive material such as a metal.

In addition, each antenna column 3150 through 3153 has a coupling web 3200, which likewise is implemented as microstrip and is connected to the microstrip connecting fifth antenna elements 3300. Coupling web 3200 of each antenna column 3150, 3151, 3152, 3153 is disposed above a first antenna element 300 of antenna 3300 and forms a first coupling structure 3700 jointly with this antenna element 300. Via first coupling structure 3700, the output radiated by the individual first antenna element 300 is coupled into antenna column 3150, 3151, 3152, 3153 coupled above respective first antenna element 300. Since antenna columns 3150, 3151, 3152, 3153 are oriented perpendicular to the first straight line, antenna columns 3150, 3151, 3152, 3153 cause focusing of the signal radiated by antenna 3100, perpendicular to the swivel plane of antenna 3100. Coupling structures 3700, as shown in FIG. 7, may be disposed in the center of individual antenna columns 3150, 3151, 3152, 3153. As an alternative, however, coupling structures 3700 may also be provided along the edges or at any other positions of antenna columns 3150, 3151, 3152, 3153.

Figure 8:
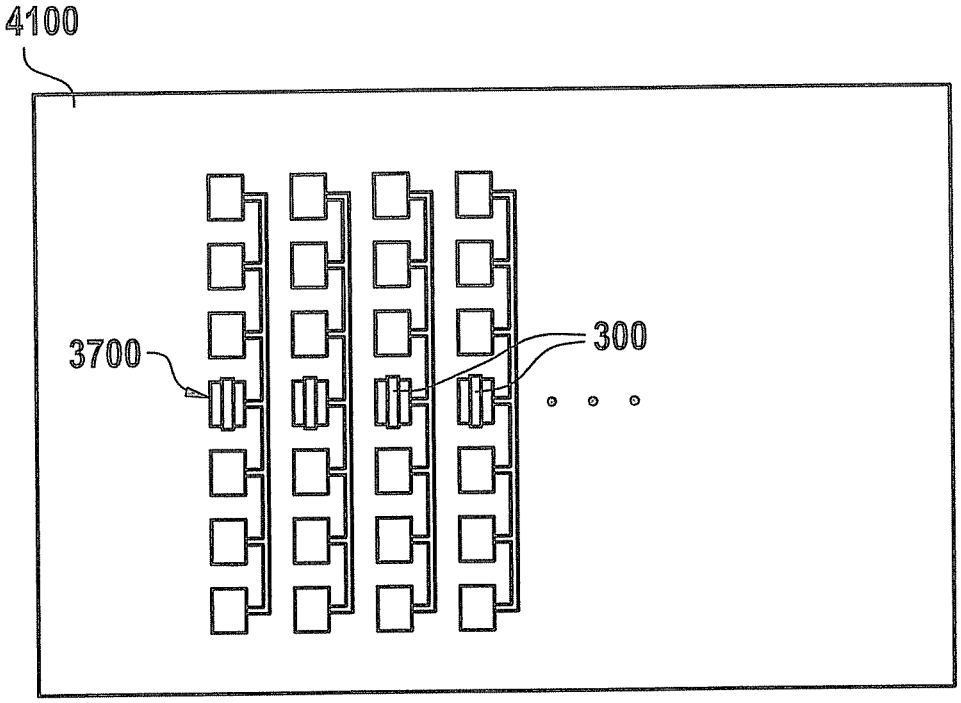
FIG. 8 shows an illustration of the antenna having additional antenna columns according to a second specific development.

FIG. 8 shows a plan view of an antenna 4100 according to another specific embodiment. Antenna 4100 also has a plurality of antenna columns which are disposed above first antenna elements 300 in each case and oriented perpendicular to the first straight line. In contrast to antenna 3100 shown in FIG. 7, however, the antenna columns of antenna 4100 have no coupling web 3200. Instead, one of fifth antenna elements 3100 of each antenna column is disposed above a respective first antenna element 300 and forms first coupling structure 3700 together with it. This, too, couples the individual output radiated by first antenna element 300 into the antenna column disposed above the particular first antenna element 300, with the result that the signal radiated via antenna 4100 is focused perpendicular to the swiveling direction. Once again, the positions of coupling structures 3700 on the antenna columns may be selected as desired.

Figure 9:
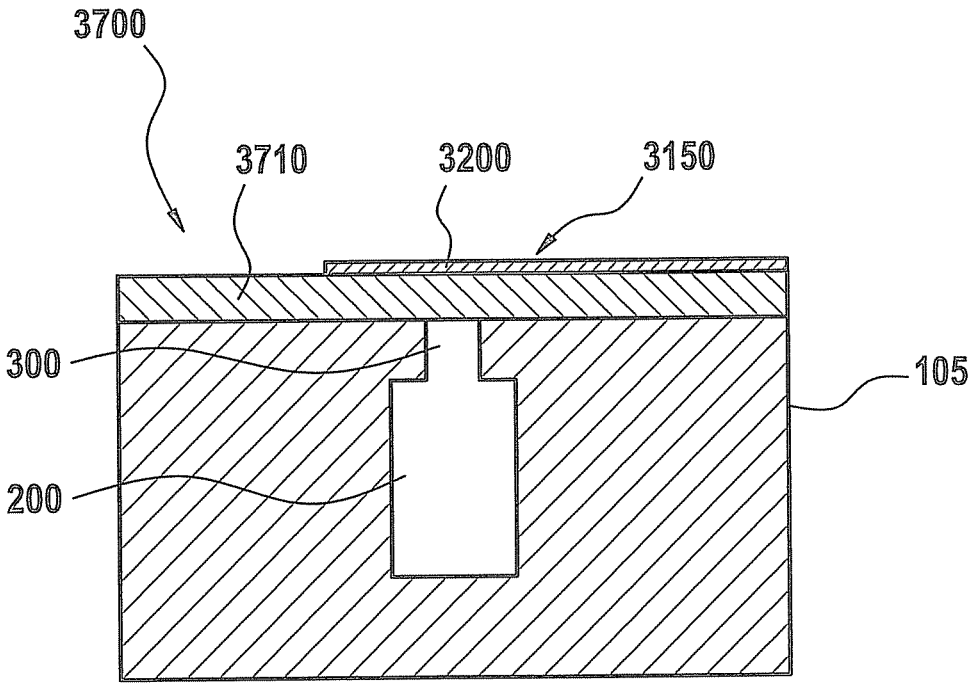
FIG. 9 shows a section through the antenna having an additional antenna column.

FIG. 9 shows a section through one of first coupling structures 3700 of antennas 3100 of FIG. 7. It can be gathered that a substrate 3710 is disposed between coupling web 3200 of antenna column 3150 and first antenna element 300. Substrate 3710 is made of an electrically insulating material and electrically insulates antenna column 3150 from antenna body 105.

Figure 10:
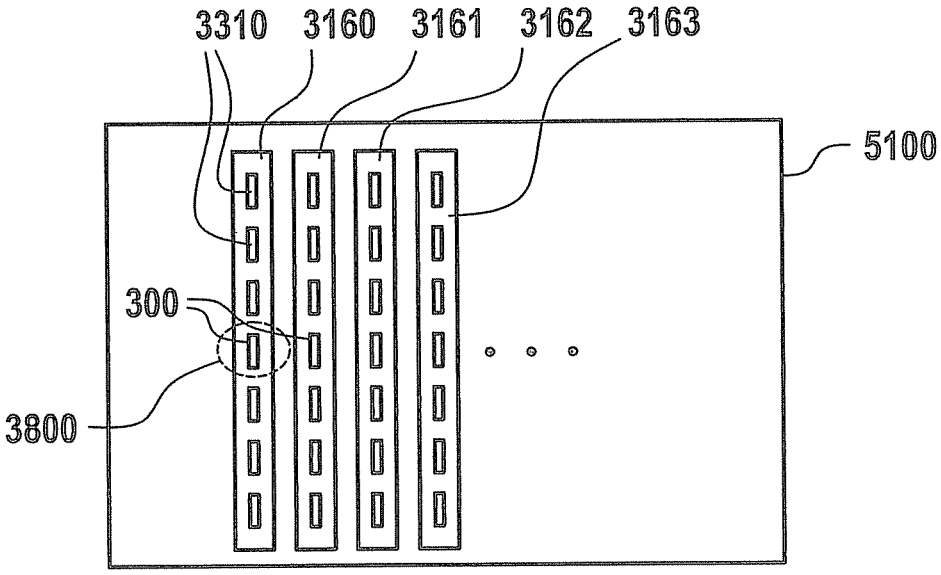
FIG. 10 shows an illustration of the antenna having additional antenna columns according to a third specific development.

FIG. 10 shows a plan view of an antenna 5100 according to another specific embodiment. Antenna 5100 once again has a plurality of first antenna elements 300, which are disposed along a first straight line. Furthermore, antenna 5100 has a plurality of antenna columns 3160, 3161, 3162, 3163, each of which is oriented perpendicular to the first straight line and disposed above one of first antenna elements 300. Each antenna column 3160, 3161, 3162, 3163 is implemented as hollow conductor antenna having a plurality of sixth antenna elements 3310. By way of a second coupling structure 3800, in a central section of each antenna column 3160, 3161, 3162, 3163, the particular antenna column 3160, 3161, 3162, 3163 is coupled to the particular first antenna element 300 situated underneath. In this way the output radiated by first antenna elements 300 is coupled into antenna columns 3160, 3161, 3162, 3163, thereby resulting in focusing of the signal emitted by antenna 5100, perpendicular to the swiveling direction of antenna 5100.

Figure 11:
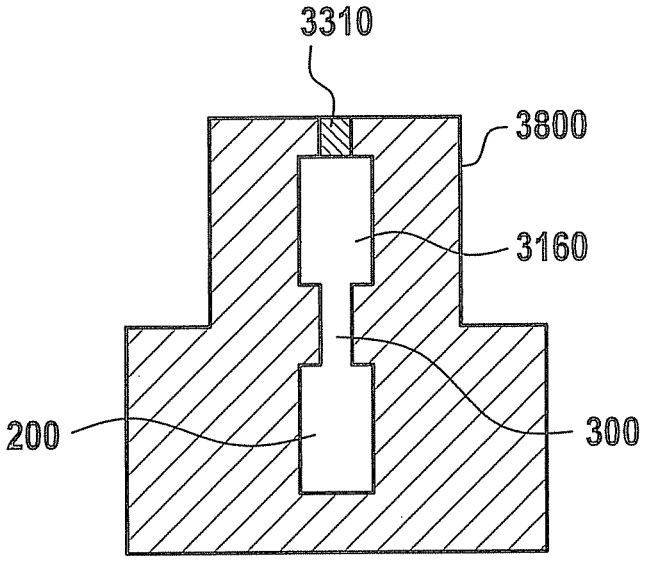
FIG. 11 shows a section through the antenna having additional antenna columns according to the third specific embodiment.

FIG. 11, in a section through antenna 5100 of FIG. 10, shows one of second coupling structures 3800. The hollow conductor of antenna column 3160 is disposed perpendicular above hollow conductor 200 of antenna 5100. The hollow conductor of antenna 5100 is connected to the hollow conductor of antenna column 3160 via one of first antenna elements 300. There is a sixth antenna element 3310 of antenna column 3160 perpendicular above the hollow conductor and first antenna element 300. Sixth antenna element 3310 may be developed as opening or be sealed by a dielectric material, for example.

Antennas 3100, 4100, 5100 of FIGS. 7 through 11 have the advantage that the antenna columns cause focusing of the signals radiated by antenna 3100, 4100, 5100, perpendicular to the particular swiveling direction, without a lens being necessary. This reduces the space required for antenna 3100, 4100, 5100.

Figure 12:
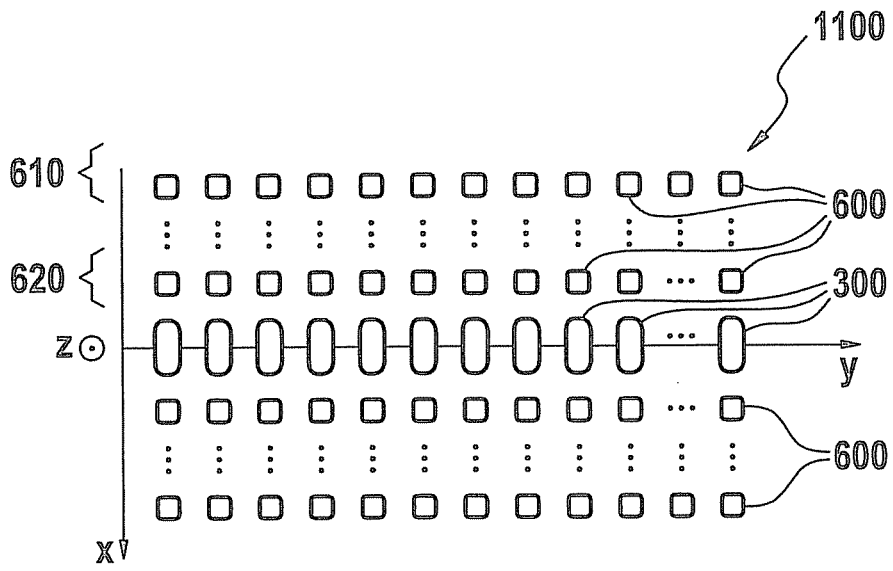
FIG. 12 shows an illustration of the antenna having additional patch elements.

FIG. 12 shows a plan view of an antenna 1100 according to another specific embodiment. Once again, antenna 1100 has a plurality of first antenna elements 300, which are disposed along a first straight line that is oriented parallel to the y-axis. In addition, antenna 1100 has a plurality of second antenna elements 600, which are disposed next to first antenna elements 300 in the x-direction. Second antenna elements 600 are situated in rows that are oriented parallel to the first straight line. FIG. 12 shows a first row 610 and a second row 620 by way of example. However, additional rows having further second antenna elements 600 may be provided. Second antenna elements 600 are developed as patch elements. Second antenna elements 600 of each row 610, 620 are connected to each other via a microstrip. The microstrip is not shown in FIG. 12. Each row 610, 620 thus form a separate patch antenna. Each row 610, 620 may be connected to separate evaluation electronics. Rows 610, 620 are able to be employed for detecting a reflected radar signal. Because rows 610, 620 are disposed next to each other in the x-direction, rows 610, 620 allow antenna 1200 to resolve the reflected radar signal in the x-direction, i.e., perpendicular to the swiveling direction of antenna 1100, as a function of the angle. Antenna 1100 is able to scan the space lying in front of antenna 1100, i.e., in the y-z plane, by swiveling the emitted radar beam, and to resolve the reflected radar signal in the x-z plane as a function of the angle. As a result, antenna 1100 achieves an excellent angular resolution both vertically and horizontally. As an alternative, second antenna elements 600 may also be used for the transmission.

Figure 13:
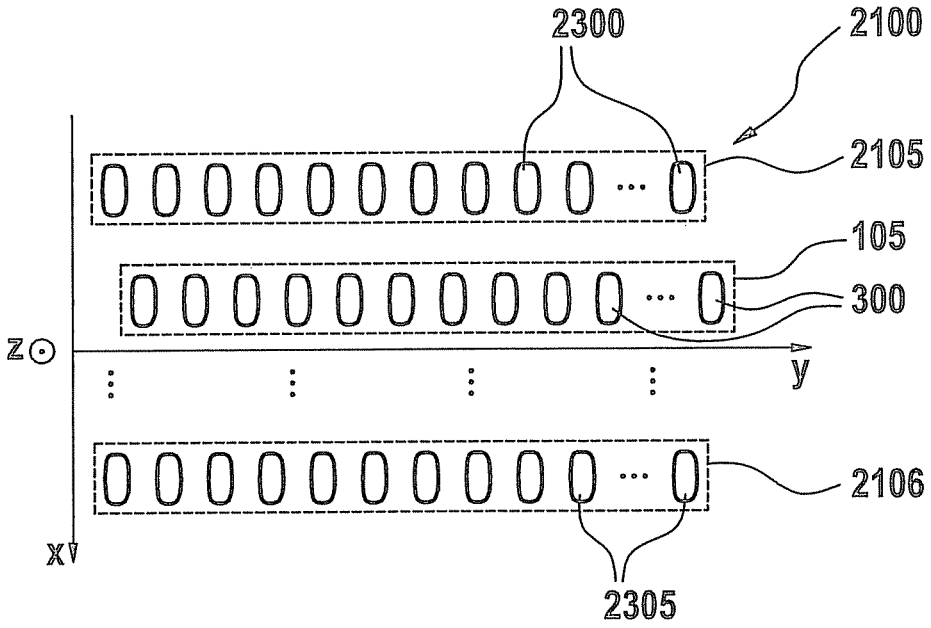
FIG. 13 shows an illustration of the antenna having additional antenna bodies.

FIG. 13 shows a plan view of an antenna 1200 according to another specific embodiment. The antenna has antenna body 105, which was already explained in connection with FIG. 1, and which includes first antenna elements 300. In addition, antenna 2100 has a second antenna body 2105 and a third antenna body 2106. Antenna 2100 may also have additional antenna bodies. Second antenna body 2105 and third antenna body 2106 correspond to first antenna body 105 with regard to their structure. For example, second antenna body 2105 has third antenna elements 2300, and third antenna body 2106 has fourth antenna elements 2305. First antenna elements 300, third antenna elements 2300, and fourth antenna elements 2305 are oriented parallel to the y-axis in each case. In the x-direction, the antenna elements of the different antenna bodies 105, 2105, 2106 may be disposed either directly on top of each other or to the side of each other.

Antenna 2100 may be used in different ways. The individual antenna bodies 105, 2105, 2106 may either be supplied by a shared high-frequency source, so that individual antenna elements 105, 2105, 2106 radiate in synchrony with each other. In this case, the partial radiation emitted by the individual antenna bodies 105, 2105, 2106 may interfere with each other, so that focusing of the radar beam emitted by antenna 2100 in the y-z plane results. The function of antenna 2100 then corresponds to the function of antennas 3100, 4100, 5100 of FIGS. 7, 8, and 10.

A second possibility for using antenna 1200 is to use only first antenna body 105 for emitting radar radiation, and to detect the reflected radar signal with the aid of second antenna body 2105 and third antenna body 2106. Antenna 2100 then achieves an angular resolution perpendicular to the swiveling direction of antenna 2100. This corresponds to the function of antenna 1100 of FIG. 12.

Figure 14:
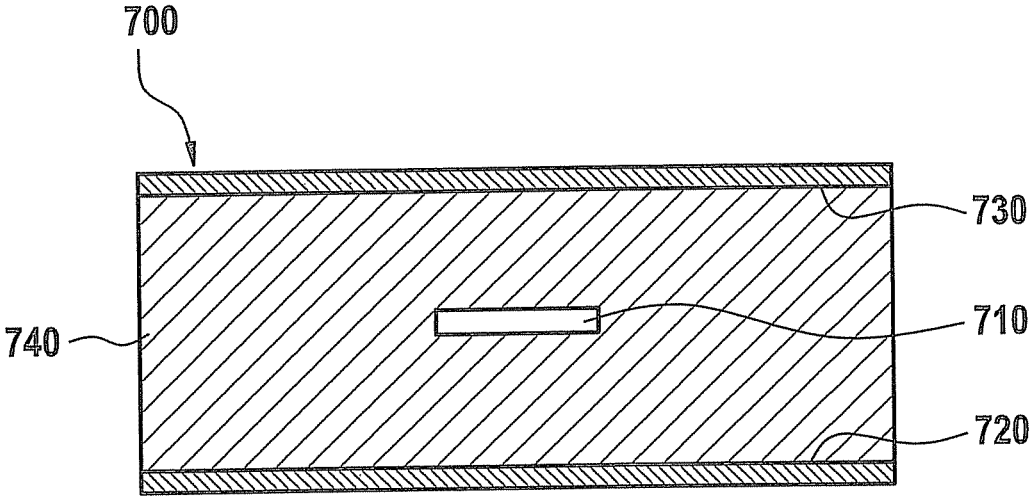
FIG. 14 an illustration of a waveguide developed as strip line.

The antennas of the previously described specific embodiments use a hollow conductor 200, which has openings that form first antenna elements 300. However, instead of a hollow conductor, it is also possible to use a microstrip. FIG. 14 shows a suitable microstrip 700 in a schematized sectional view. Microstrip 700 has a first mass surface 720 and a second mass surface 730. First mass surface 720 and second mass surface 730 are made of an electrically conductive material, e.g., a metal. A dielectric 740 is disposed between first mass surface 720 and second mass surface 730. Embedded in dielectric 740 is a signal conductor 710. Signal conductor 710 is made of an electrically conductive material such as metal, for example. Just like hollow conductor 200, microstrip 700 may be used as waveguide for a high-frequency electromagnetic wave. First mass element 720 and/or second mass element 730 are/is able to have one or several opening(s), which are used as antenna elements. The antenna elements formed in this manner correspond to first antenna elements 300.

The List of reference numerals is as follows:

100 antenna
105 antenna body
110 the upper part of the antenna body
120 the lower part of the antenna body
200 hollow conductor
210 input
220 output
230 compensation structure
300 first antenna elements
310 first diameter
320 second diameter
330 outer antenna element
340 central antenna element
400 first directional characteristic
410 first side lobe attenuation
420 second directional characteristic
430 second side lobe attenuation
500 lens
600 second antenna elements
610 first row
620 second row
700 microstrip
710 signal conductor
720 first mass surface
730 second mass surface
740 dielectric
1100 antenna
2100 antenna
2105 second antenna body
2106 third antenna body
2300 third antenna elements
2305 fourth antenna elements
3100 antenna
3150 first antenna column
3151 second antenna column
3152 third antenna column
3153 fourth antenna column
3160 antenna column
3161 antenna column
3162 antenna column
3163 antenna column
3200 coupling web
3300 fifth antenna elements
3310 sixth antenna elements
3700 first coupling structure
3710 substrate
3800 second coupling structure
4100 antenna
5100 antenna

What is claimed is:

1. An antenna, comprising:

an antenna body that includes a plurality of first antenna elements, which are disposed along a first straight line;

a hollow conductor, disposed in the antenna body, which conductor extends between the first antenna elements;

wherein the first antenna elements are implemented as openings extending between the hollow conductor and a surface of the antenna body, wherein the antenna is configured to radiate a signal in one spatial direction, the spatial direction being a function of a frequency of the signal, and wherein the antenna body has an electrically insulating material, which is coated with a conductive material; and a plurality of antenna columns, wherein each antenna column includes a plurality of fifth antenna elements, wherein each antenna column is oriented perpendicularly to the first straight line, wherein in each antenna column, all the fifth antenna elements of the antenna column are coupled to a respective one of the first antenna elements via a coupling structure, and wherein each antenna column is configured as a microstrip antenna, and wherein the fifth antenna elements are configured as patch elements.

2. The antenna of claim 1, wherein the insulating material is polyetherimide or polybutylene terepthalate.

3. The antenna of claim 1, wherein the antenna body is produced with the aid of an injection-molding process.

4. The antenna of claim 1, wherein the insulating material is glass.

5. The antenna of claim 4, wherein the antenna body is produced with the aid of an embossing process.

6. The antenna of claim 1, wherein the electrically conductive material is deposited using one of a physical vapor-phase deposition process and a galvanic coating process.

7. The antenna of claim 1, wherein a medium, which is transparent to radar radiation, is provided in the hollow conductor.

8. The antenna of claim 1, wherein the hollow conductor has at least one compensation structure, which is configured so that interference with the hollow conductor caused by the first antenna elements is compensated.

9. The antenna of claim 1, wherein at least two of the first antenna elements radiate different amounts of output.

10. The antenna of claim 9, wherein the output radiated by the first antenna elements interferes so that a side lobe attenuation of the radiated output amounts to more than 25 dB in the distant field.

11. The antenna of claim 9, wherein the first antenna elements include an outer antenna element and a central antenna element, the opening forming the outer antenna element having a first diameter, the opening forming the central antenna element having a second diameter, the first diameter and the second diameter being different.

12. The antenna of claim 1, wherein:

the antenna receives an input signal having a frequency, the first antenna elements include a center first antenna element, a magnitude of the output radiated by each of the first antenna elements in response to the input signal is approximately proportional to the square of the cosine of the distance, scaled to $\pi/2$, of the first antenna element from the center first antenna element, and a scaled distance of first antenna elements that are not the center first antenna element is greater than zero and at most equal to $\pi/2$.

13. The antenna of claim 1, wherein the antenna has a lens, which has a shape of a cylinder segment, wherein a longitudinal axis of the lens is oriented parallel to the first straight line, and wherein the lens has a dielectric material.

14. The antenna of claim 13, wherein the lens includes polyetherimide.

15. The antenna of claim 1, wherein the antenna has a plurality of second antenna elements, which are disposed outside of the first straight line, wherein the second antenna elements are patch elements, and wherein at least two of the second antenna elements are connected to each other via a microstrip.

16. The antenna as recited in claim 15, wherein the second antenna elements are disposed in one row, which is oriented parallel to the first straight line, the second antenna elements in the row being connected to each other by a microstrip.

17. The antenna of claim 1, wherein the antenna has a second antenna body, which has a plurality of third antenna elements, which are disposed along a second straight line, the second straight line being oriented parallel to the first straight line, a second hollow conductor, which extends between the third antenna elements, being disposed in the second antenna body, the third antenna elements being configured as openings extending between the second hollow conductor and a surface of the second antenna body.

18. The antenna of claim 1, further comprising:

a substrate between the antenna body and the antenna columns.

19. An antenna, comprising:

an antenna body that includes a plurality of first antenna elements, which are disposed along a first straight line;

a hollow conductor, disposed in the antenna body, which conductor extends between the first antenna elements;

wherein the first antenna elements are implemented as openings extending between the hollow conductor and a surface of the antenna body, wherein the antenna is configured to radiate a signal in one spatial direction, the spatial direction being a function of a frequency of the signal, and wherein the antenna body has an electrically insulating material, which is coated with a conductive material; and at least one antenna column, which has a plurality of sixth antenna elements, wherein the antenna column is oriented perpendicularly to the first straight line, and wherein the antenna column is coupled to a first antenna element via a coupling structure, wherein the antenna column is configured as a hollow conductor, and wherein the sixth antenna elements are implemented as openings in this hollow conductor.

* * * * *